United States Patent [19]

Zanni

[11] 4,251,976

[45] Feb. 24, 1981

[54] PROCESS FOR PACKING FOODSTUFFS UNDER VACUUM

[75] Inventor: Paolo Zanni, Firenze, Italy

[73] Assignee: FIAP s.r.l., Bologna, Italy

[21] Appl. No.: 65,750

[22] Filed: Aug. 10, 1979

[30] Foreign Application Priority Data

Aug. 11, 1978 [IT] Italy ..... 68894 A/78

[51] Int. Cl.[3] ..... B65B 31/08

[52] U.S. Cl. ..... 53/433; 53/434; 53/512

[58] Field of Search ..... 53/433, 434, 511, 512, 53/79

[56] References Cited

U.S. PATENT DOCUMENTS 3,382,642 5/1968 Shaw ..... 53/434

FOREIGN PATENT DOCUMENTS 689714 4/1953 United Kingdom .
767305 1/1957 United Kingdom .
1353697 5/1974 United Kingdom .
1508166 4/1978 United Kingdom .

*Primary Examiner*—Travis S. McGehee
*Attorney, Agent, or Firm*—Browdy and Neimark

[57] ABSTRACT

Disclosed herein is a simple and economical process for packing foodstuffs under vacuum in the home in a way compatible with that achieved on a large industrial scale with the use of complex, costly equipment. The process in question comprises, among other things, the following operations: the preparation of a bag, made of flexible heat sealable plastic material having, at one extremity, an open mouth; the insertion into the bag of the product to be preserved under vacuum; the preparation of a spacer member provided with at least one tubular projecting part, the free extremity of which has a cutting edge, while the other extremity communicates with at least one opening directed orthogonally with respect to the said tubular projecting part; the insertion of the spacer member into the inside of the bag, a short distance away from the mouth of this, the tubular projecting part thereof being directed perpendicularly with respect to the plane of the bag; the pressing of one of the walls of the bag against the said tubular projecting part so that the latter may perforate and pass through the said wall of the bag; the carrying out of a linear heat sealing operation on the walls of the bag, in the area in between the spacer member and the mouth of the bag; the extraction of the air contained in the bag via the tubular projecting part of the spacer member; the carrying out of a second linear heat sealing operation on the walls of the bag, in the area in between the product to be preserved and the spacer member, in a position adjacent to the latter. Furthermore, this invention also relates to a portable apparatus for carrying out linear heat sealing operations on sheets of thermoplastic material and for cutting contiguously to the sealing lines.

7 Claims, 15 Drawing Figures

FIG1
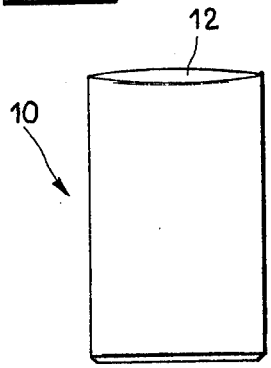
FIG2
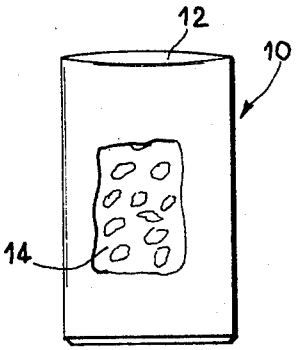
FIG3
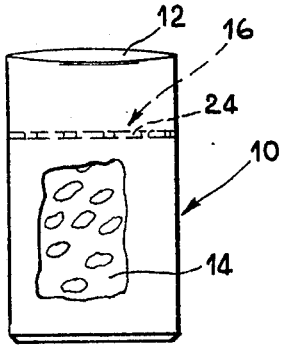
FIG4
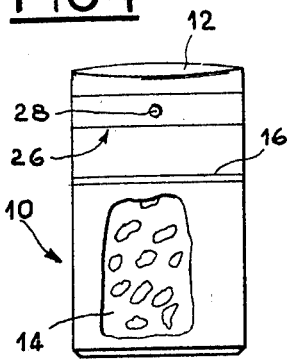
FIG5
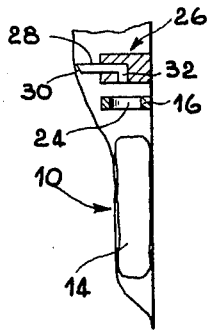
FIG6
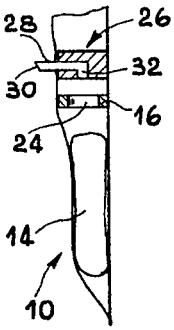
FIG7
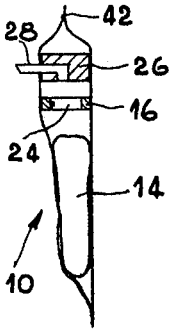
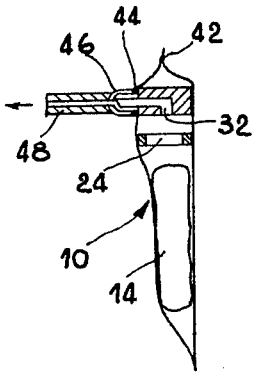
FIG8
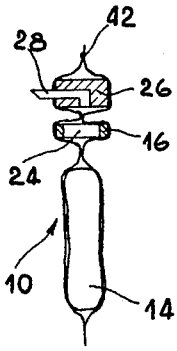
FIG9
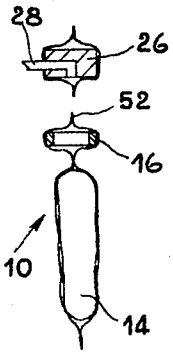
FIG10
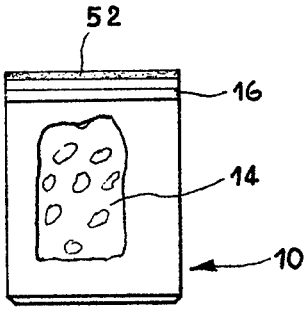
FIG11

26
38
38'
28
30
34
36
32
40
16
18
20
22
24

PROCESS FOR PACKING FOODSTUFFS UNDER VACUUM

BACKGROUND OF THE INVENTION

The present invention relates to a process for packing foodstuffs under vacuum.

DESCRIPTION OF THE PRIOR ART

Various processes are known for packing vacuumized food products but each and every one of these calls for the use of complex, costly equipment and is certainly not suitable for domestic use.

SUMMARY OF THE INVENTION

The object of the present invention is to make available a process for packing foodstuffs under vacuum, just as is done on a large industrial scale with the use of complex and costly plants and equipment, which can be carried out in a simple and economical fashion on apparatus of a limited cost and of restricted dimensions.

With a view to achieving the said object, the present invention has as its subject a process for packing foodstuffs under vacuum, essential features of which are that is comprises the following operations:

the preparation of a bag, made of flexible heat sealable plastic material having, at one extremity, an open mouth;

the insertion into the bag of the product to be preserved under vacuum;

the preparation of a spacer member provided with at least one tubular projecting part, the free extremity of which has a cutting edge, while the other extremity communicates with at least one opening directed orthogonally with respect to the said tubular projecting part;

the insertion of the spacer member into the inside of the bag, a short distance away from the mouth of this, the tubular projecting part thereof being directed perpendicularly with respect to the plane of the bag;

the pressing of one of the walls of the bag against the said tubular projecting part so that the latter may perforate and pass through the said wall of the bag;

the carrying out of a linear heat sealing operation on the walls of the bag, in the area in between the spacer member and the mouth of the bag;

the extraction of the air contained in the bag via the tubular projecting part of the spacer member;

the carrying out of a second linear heat sealing operation on the walls of the bag, in the area in between the product to be preserved and the spacer member, in a position adjacent to the latter;

the cutting of the bag contiguously to the second sealing line.

In order to guarantee the perfect air tight sealing of the area of the wall of the bag through which the tubular projecting part passes during the operation of extracting the air contained in the bag, according to a further characteristic of the invention, the process comprises the supplementary operations of preparing a tubular pipe union shaped like a dome, connected to a source of vacuum, and provided with sealing means that give elastically in the region of the border thereof, and of fitting, through pressure, the edge of the said dome shaped member onto the bag in such a way that the said member seals peripherally the aforementioned tubular projecting part of the spacer member that protrudes from the bag prior to the stage when the air is sucked out of the bag.

So as to guarantee perfect alignment between the walls of the bag and prevent folds and wrinkles from forming in the region of the part of the bag destined to have the second heat sealing operation performed on it, the process according to the invention comprises, according to a further characteristic, the following supplementary operations:

the preparation of a tensioning member of a length substantially equal to the width of the bag, provided with a plurality of transverse passages;

the insertion of the tensioning member into the inside of the bag before the spacer member is inserted therein, so that the extremities of the former meet the lateral edges of the bag.

The invention has, furthermore, as its subject, an apparatus designed to facilitate the carrying out of the process. The said apparatus is portable and performs linear heat sealing operations on sheets of thermoplastic material which it cuts contiguously to the sealing lines. The said apparatus comprises a casing provided with a support platform that incorporates electrical heating means and a cover hinged along one edge of the support platform and carrying a slide connected to a blade turned towards the support platform, essential features of the apparatus being that, furthermore, it comprises at least one tubular pipe union shaped like a dome, incorporated in the cover so that the edge thereof be placed opposite the support platform at the time the cover is closed, the said edge having around the circumference thereof sealing means that give elastically, and a vacuum pump connected laterally to the support platform and having its suction mouth connected to the said tubular pipe union.

BRIEF DESCRIPTION OF THE DRAWINGS

Further characteristics of the invention will become apparent from the detailed description that follows, with reference to the accompanying drawings, given purely as an unlimited example, in which:

FIGS. 1 to 4 show, in plan view form, a bag made of flexible heat sealable plastic material during four subsequent stages of the process according to the invention;

FIGS. 5 to 10 show, in longitudinal sectional form, the bag depicted in FIGS. 1 to 4 during further subsequent stages of the process;

FIG. 11 is a plan view of the bag depicted in FIGS. 1 to 10 upon completion of the process;

DESCRIPTION OF THE PREFERRED EMBODIMENT

The first operation in the process according to the invention consists in the preparation of a bag 10, made of flexible heat sealable plastic material (FIG. 1). The bag 10, preferably made of transparent plastic material and provided at one extremity with an open mouth 12, can be produced by heat sealing and cutting in a crosswise direction, a continuous strip in the form of a flattened tube, wound in rolls and available on the market.

Subsequently, inside the bag 10 are inserted a food product 14 to be preserved under vacuum (FIG. 2) and a tensioning member 16 (FIG. 3).

Figures 13, 14, 15:
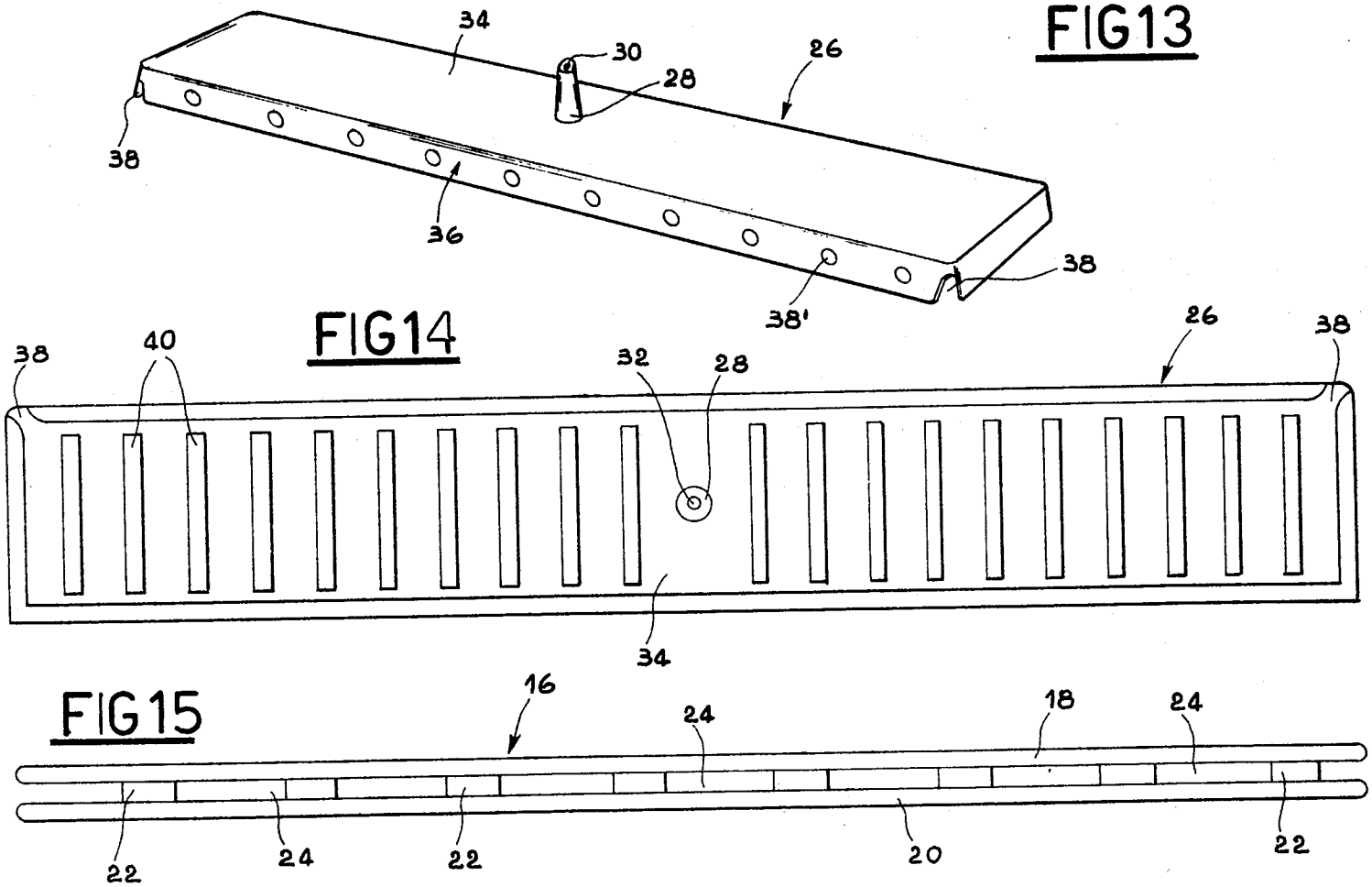
FIG. 13 is a perspective view of the spacer member shown in FIGS. 4 to 10.
FIG. 14 is a plan view, seen from the bottom, of FIG. 13.
FIG. 15 is a front elevation of the tensioning member shown in FIGS. 1 to 11.

The tensioning member 16, illustrated in greater detail in FIG. 15, is constituted by a pair of strips 18 and 20, superposed one over the other and made of rigid plastic material, the length of which is substantially the same as the width of the bag 10. The said strips 18 and 20 are interconnected by a plurality of sectional pieces 22 which are interspaced and delimitate a plurality of transverse passages 24. The tensioning member 16 is inserted in the inside of the bag 10, a short distance away from the mouth 12, so that the extremities of the strips 18 and 20 come into contact with the lateral edges of the bag in order to keep the walls of the bag 10 aligned with each other and prevent wrinkles from forming in the area of the bag 10 adjacent to the tensioning member 16, particularly in the region of the part of the said area that is turned towards the mouth 12.

A spacer member 26 is then inserted inside the bag 10 and this is provided with at least one tubular projecting part 28 having a cutting edge 30 in the region of the free extremity thereof and communicating, at the other extremity, with at least one opening 32 machined into the spacer member 26 orthogonally with respect to the tubular projecting part 28. In the example illustrated, the spacer member 26 comprises, as shown in detail in FIGS. 13 and 14, an elongated plate 34 of quadrangular shape, made of rigid plastic material. The plate 34 is substantially identical in length to the width of the bag 10 (for obvious practical reasons) and it has running through the center, the tubular projecting part 28 which extends, cantilever fashion, perpendicularly from one of its major dimensional sides. The plate 34 is provided, along the circumference thereof, with a peripheral border 36 that is bent back on the opposite side to the tubular projecting part 28 and is provided with the openings 38 in the region of at least the corners of one of the major dimensional sides thereof, and it has a plurality of transverse spacer pieces 40 that are interspaced and extend perpendicularly, cantilever fashion, from the other side of the plate 34 inside the peripheral border 36. Naturally a number of holes 38' can be drilled, suitably spaced, in the peripheral border 36, just as the said spacer member 26 can be made in the form of a closed box with the said holes 38 and/or 38'.

The spacer member 26 is inserted in the inside of the bag 10 in a position midway between the tensioning member 16 and the mouth 12, parallel to the tensioning member 16, with the tubular projecting part 28 directed perpendicularly with respect to the plane of the bag 10 (FIGS. 4 and 5).

The subsequent operation consists in pressing one of the walls of the bag 10 against the tubular projecting part 28, in such a way as to cause it to perforate and pass through the said wall of the bag 10 (FIG. 6).

After this, a transverse heat sealing operation, shown at 42 (FIG. 7), is performed on the walls of the bag 10, in the area in between the spacer member 26 and the mouth 12 of the bag 10, so as to seal the latter hermetically.

The edge, provided with a sealing gasket 44, of a tubular pipe union 46, shaped like a dome, is then placed onto the bag 10 through pressure, in such a way that the said pipe union 46 seals circumferentially the tubular projecting part 28 of the spacer member 26 that protrudes from the wall of the bag 10 (FIG. 8).

The tubular pipe union 46 is connected to a source of vacuum via a pipe 48.

The air contained in the inside of the bag 10 can then be sucked out through the tubular projecting part 28, the hole 32, which in the example illustrated is constituted by channels in between the spacer pieces 40 and by the openings 38 (38') in the spacer member 26, and through the passages 24 in the tensioning member 16. During this stage, the gasket 44 ensures there being a perfect seal in the area of the wall of the bag 10 through which the tubular projecting part 28 passes.

Upon completion of this operation, a second transverse heat sealing operation, shown at 52 (FIG. 10), is performed in the area in between the spacer member 26 and the tensioning member 16, the presence of which contributes, as stated previously, in preventing the wrinkling of the walls of the bag 10 in the region of the area destined to have the second heat sealing operation 52 carried out thereon.

When the said operation has been completed, the tubular pipe union 46 can be extracted from the tubular projecting part 28 and the spacer member 26 is separated, through a transverse shearing operation adjacently to the sealing line 52, from the bag 10 (FIG. 10).

At the end of the process, the product 14 is contained vacuumized inside the bag 10 and the tensioning member 16 (FIG. 11) remains incorporated therein, though it can be subsequently recovered and utilized again following the opening of the bag 10 at the time the product 14 is extracted therefrom.

The spacer member 26 utilized in the process according to the invention could be of a shape differing from that previously described.

The said spacer member 26 could, in fact, be of block conformation, of a length less than the width of the bag 10, or it could simply be constituted by an L shaped tubular pipe union in which the spacing action between the walls of the bag 10 would be attended to by the part of the said pipe union that extends longitudinally inside the bag 10. The conformation of the spacer member 26 must, however, be such as to guarantee a volume sufficient to allow the gradual extraction of the air, especially during the initial stage when, if the said volume were lacking, there would be an undesirable closing of the walls of the bag and the vacuumization would consequently be impeded.

The tensioning member 16 could also be in a different form from that illustrated and, for example, be constituted by a quadrangular frame or by a U shaped member inserted inside the bag 10 with the base thereof positioned transversely and the lateral walls thereof adjacent to the lateral edges of the bag 10, the purpose of this being to foster better suction in the region of the areas close to the product to be preserved.

Figure 12:
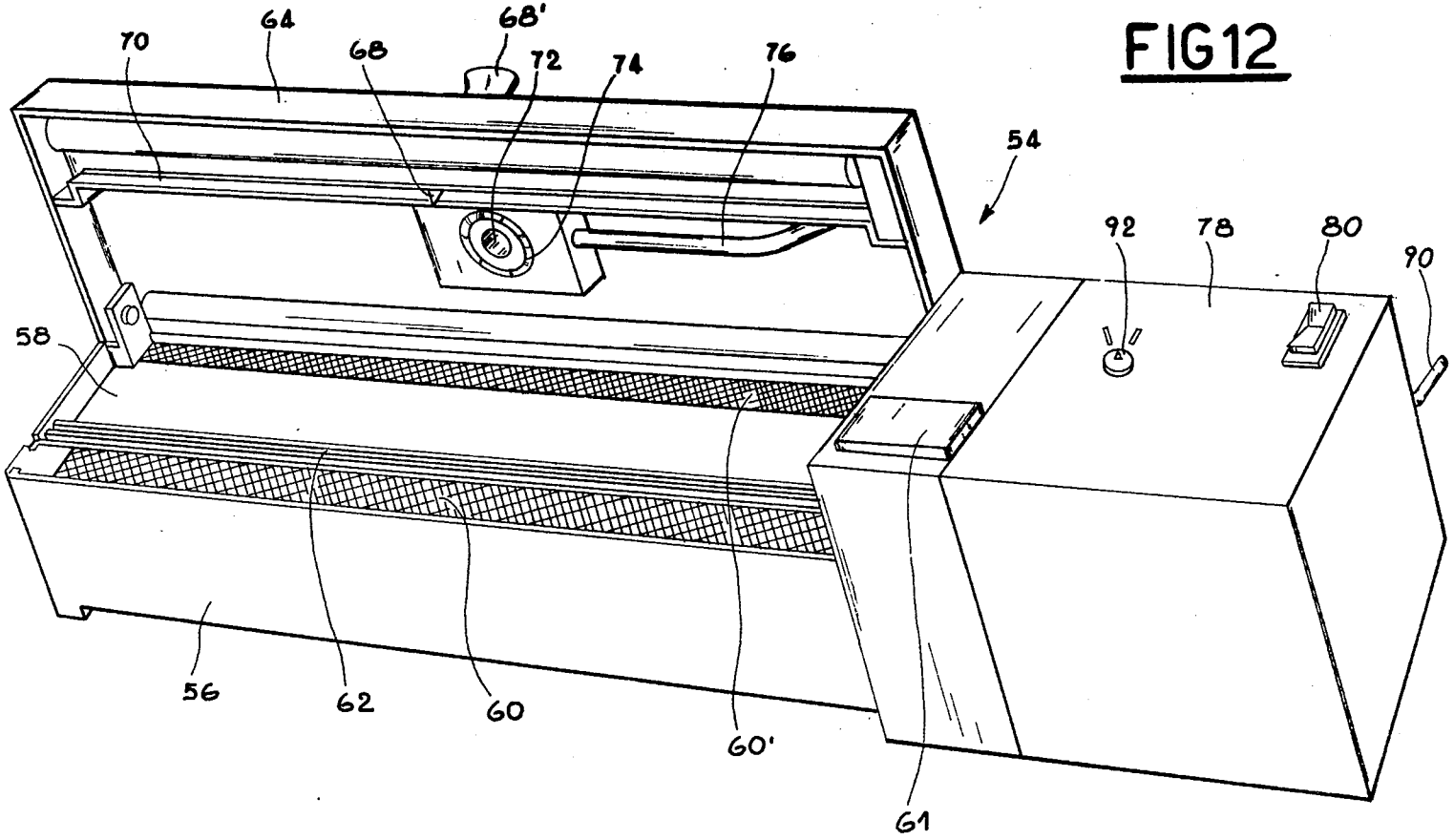
FIG. 12 is a perspective view of a portable apparatus for executing heat sealing operations on sheets made of plastic material and for cutting these contiguously to the sealing lines, modified to permit the process illustrated in FIGS. 1 to 11 to be carried out.

In FIG. 12 a preferred method for carrying out the previously described process is illustrated.

The apparatus, shown in its entirety at 54, comprises a casing 56 provided at the top with a support platform 58 of quadrangular shape.

Incorporated in the support platform 58, in proximity of the major dimensional sides thereof, there are two electrical heating elements, not shown on the drawing, covered at the top by the grids 60 and 60'. The said electric heating elements can be connected, at different times, to a non-illustrated electricity supply source through a control pushbutton 61.

At 62 there is a C shaped longitudinal guide placed adjacent to the grid 60 with its opening turned upwards.

At 64 there is a cover in the form of a tray, the dimensions of which are the same as those of the support platform 58, and this is hinged, in the region of the extremities of one of the major dimensional sides thereof, to the extremities of the edge of the support platform 58 adjacent to the grid 60'. The cover 64 is movable between a vertical position, illustrated on the drawing, and a horizontal position in which it is superposed over the support platform 58.

The cover 64 carries a slide 68' connected to a blade 68 turned towards the inside of the cover 64, which can slide in a slit 70 aligned, in the closed position of the cover 64, with the longitudinal guide 62.

Incorporated inside the cover 64 there is a tubular pipe union 72, shaped like a dome and identical to the previously described tubular pipe union 46, which is so positioned that the edge thereof is opposite the support platform 58 when the cover 54 is in the closed position. The said edge of the tubular pipe union 72 has around the circumference thereof a sealing gasket 74 made of elastomer material, corresponding to the previously described gasket 44.

The tubular pipe union 72 is connected, via a pipe 76, to the suction mouth of a vacuum pump secured laterally to the support platform 58 and connected, through the interposition of an operating pushbutton 80, to a non-illustrated electricity supply source.

The above described portable apparatus 54 makes the stages of the process described previously with reference to FIGS. 5 to 10 achievable. Following the insertion into the inside of the bag 10 of the product to be preserved, of the tensioning member 16 and of the spacer member 26, the mouth 12 of the said bag 10 is, in fact, sealed hermetically by being heat sealed through the electric heating elements 60' of the apparatus 54, after the pushbutton 61 has been initially operated.

For the said operation to be effected, the bag 10 is rested on the support platform 58 in such a way that the tubular projecting part 28 is centered, with respect to the tubular pipe union 72, in the closed position of the cover 64. In this way, because of the closing of the said cover 64, the tubular projecting part 28 perforates and passes through the wall of the bag 10 that is turned towards the cover 64, and it penetrates inside the tubular pipe union 72. Contemporaneously, the sealing gasket 74 placed on the edge of the tubular pipe union 72 attaches itself with pressure to the surface of the bag 10 and touches against the spacer member 26 so as to ensure the area of the wall of the bag 10 through which the tubular projecting part 28 passes being sealed perfectly hermetically. The vacuum pump 78 is subsequently actuated, through the operating pushbutton 80, so as to extract the air contained in the bag 10 via the tubular projecting part 28 and the openings machined in the spacer member 25 and in the tensioning member 16.

When this operation is over, through the operating pushbutton 61 being actuated a second time, the electric heating elements 60 are energized so as to effect the second heat sealing operation 52 between the walls of the bag 10 and the area in between the spacer member 26 and the tensioning member 16, and then the latter is separated from the bag 10 through the manual operation of the slide 68' that carries the blade 68 cutting the bag 10 in a position adjacent to the second sealing line 52.

It is obvious from the preceding description that the apparatus 54, cheap to manufacture and of limited dimensions, enables the process according to the invention to be carried out in a simple and economical way and, therefore, that it is particularly suitable for domestic uses. The apparatus is, furthermore, also set up for an eventual alternative use to extract the air contained inside containers made of rigid material, in themselves known, used for the vacuumized preservation of food products. For this purpose, the apparatus 54 is provided with a pipe 90 that extends externally to the vacuum pump 78, one extremity of which can be connected to the suction mouth of the vacuum pump 78, and the other to a connector carried by a rigid container for the preservation of vacuumized food products, not illustrated on the drawings. Furthermore, the outside of the vacuum pump is provided with a selector switch 62 that is operated manually to place the suction mouth of the pump either in communication with the pipe 76, in order to allow the procedure described previously to be put into execution, or with the pipe 90 so as to extract the air from the aforementioned rigid container.

Naturally, leaving the principle of the invention unchanged, the constructional details and the forms of embodiment thereof can be amply varied with respect to what has been described and illustrated herein, without in any way deviating from the framework of the invention.

What is claimed is:

1. A process for packing foodstuffs under vacuum, essential features of which are that it comprises the following operations:

- the preparaion of a bag 10, made of flexible heat sealable plastic material having, at one extremity, an open mouth 12;
- the insertion into the bag 10 of the product 14 to be preserved under vacuum;
- the preparation of a spacer member 26 provided with at least one tubular projecting part 28, the free extremity of which has a cutting edge 30, while the other extremity communicates with at least one opening 32 directed orthogonally with respect to the said tubular projecting part 28;
- the insertion of the spacer member 26 into the iside of the bag 10, a short distance away from the mouth 12 of the bag 10, the tubular projecting part 28 thereof being directed perpendicularly with respect to the plane of the bag 10;
- the pressing of one of the walls of the bag 10 against the said tubular projecting part 28 so that the latter may perforate and pass through the said wall of the bag 10;
- the carrying out of a linear heat sealing operation 42 on the walls of the bag 10, in the area in between the spacer member 26 and the mouth 12 of the bag 10;
- the extraction of the air contained in the bag 10 via the tubular projecting part 28 of the spacer member 26;
- the carrying out of a second linear heat sealing operation 52 on the walls of the bag 10, in the area in between the product 14 to be preserved and the spacer member 26, in a position adjacent to the latter;
- the cutting of the bag 10 contiguously to the second sealing line 52.

2. A process according to claim 1, essential features of which are that it comprises, furthermore, the following operations:

the preparation of a tubular pipe union 46, shaped like a dome, connected to a source of vacuum and provided with sealing means 44 that give elastically in the region of the edge thereof;

the placing, through pressure, of the edge of the said tubular pipe union 46, shaped like a dome, on the bag 10 in such a way that the said pipe union 46 seals circumferentially the aforementioned tubular projecting part 28 of the spacer member 26 that protrudes from the bag 10, prior to the stage when the air is sucked out of the bag 10.

3. A process according to claim 1, essential features of which are that it comprises, furthermore, the following operations:

the preparation of a tensioning member 16 of a length substantially the same as the width of the bag 10, which is provided with a plurality of transverse passages 24;

the insertion of the tensioning member 16 into the inside of the bag 10 prior to the insertion of the spacer member 26, so that the extremities of the former touch against the lateral edges of the bag 10.

4. A process according to claim 1, wherein the spacer member 26 comprises an elongated quadrangular plate 34, made of rigid material, which is of a length substantially the same as the width of the bag 10, and has running through it the aforementioned tubular projecting part 28 that extends, cantilever fashion, perpendicularly from one of its major dimensional sides.

5. A process according to claim 3, wherein the tensioning member 16 comprises a pair of strips, superposed one over the other and made of rigid material, the length of which is substantially the same as the width of the said bag 10, the said strips being connected to each other by a plurality of interspaced sectional pieces 22.

6. A process according to claim 4, wherein the spacer member, in the region of the side of the plate 34 not provided with the tubular projecting part 28, is provided with a plurality of interspaced transverse spacer pieces 40.

7. A process according to any one of claims 1 to 6, wherein the bag 10 preparation stage comprises the operations of heat sealing and transversely shearing a continuous strip in the form of a flattened tube.

* * * * *